US005477689A

United States Patent [19]

Guillard et al.

[11] Patent Number: 5,477,689

[45] Date of Patent: Dec. 26, 1995

[54] PROCESS AND INSTALLATION FOR THE PRODUCTION OF GASEOUS OXYGEN AND/OR GASEOUS NITROGEN UNDER PRESSURE

[75] Inventors: Alain Guillard; Norbert Rieth, both of Paris, France

[73] Assignee: L'Air Liquide, Societe Anonyme pour l'Etude et l'Exploitation des Procedes Georges Claude, Paris, France

[21] Appl. No.: 300,195

[22] Filed: Aug. 29, 1994

[30] Foreign Application Priority Data

Sep. 1, 1993 [FR] France ..... 93 10417

[51] Int. Cl.[6] ..... F25J 3/02

[52] U.S. Cl. ..... 62/25; 62/38; 62/41

[58] Field of Search ..... 62/25, 38, 41

[56] References Cited

U.S. PATENT DOCUMENTS 5,157,926 10/1992 Guilleminot ..... 62/24

5,329,776 7/1994 Grenier ..... 62/38

5,365,741 11/1994 Roberts et al. ..... 62/38

FOREIGN PATENT DOCUMENTS 2674011 9/1992 France .

*Primary Examiner*—Ronald C. Capossela

*Attorney, Agent, or Firm*—Young & Thompson

[57] ABSTRACT

A process and installation for the production of gaseous oxygen and/or gaseous nitrogen under pressure by distillation of air in a double column (9), which comprises pumping (in 13) at least one liquid product withdrawn from the base of the low pressure column (11), and vaporization (in 8) of the compressed liquid product by heat exchange with the air brought to a high air pressure. All of the air to be distilled is brought to the high air pressure, and the excess fraction of this air is expanded in two turbines in series (5, 6) to the pressure of the medium pressure column (10), the air being partially reheated (in 22) between the two turbines.

6 Claims, 1 Drawing Sheet

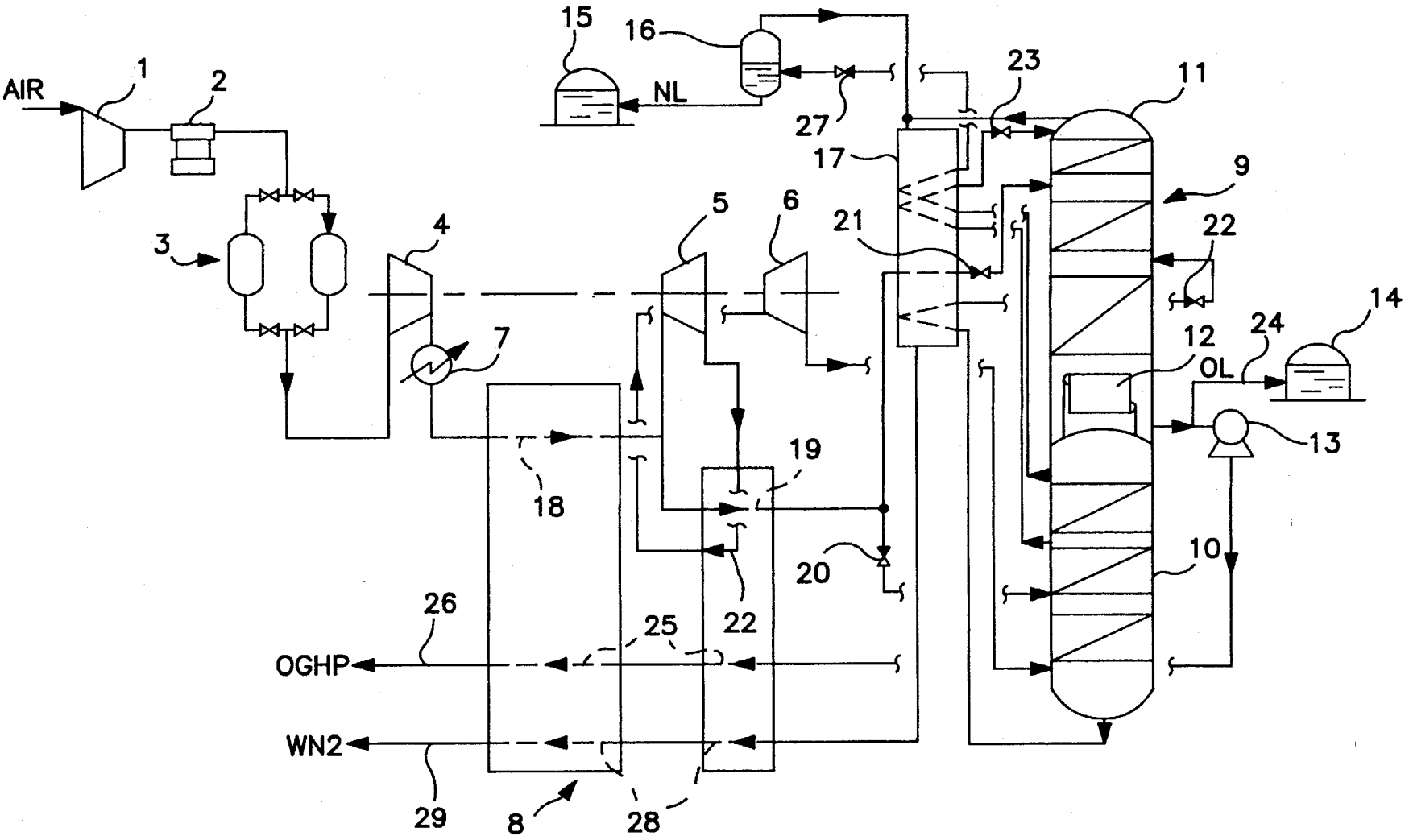
AIR
1
2
3
4
5
6
7
8
9
10
11
12
13
14
15
16
17
18
19
20
21
22
23
24
25
26
27
28
29
OL
NL
OGHP
WN2

PROCESS AND INSTALLATION FOR THE PRODUCTION OF GASEOUS OXYGEN AND/OR GASEOUS NITROGEN UNDER PRESSURE

The present invention relates to a process for the production of gaseous oxygen and/or gaseous nitrogen under pressure, of the type in which:

- the air is distilled in a double distillation column comprising a low pressure column operating under a so-called low pressure, and a medium pressure column operating under a so-called medium pressure;
- all the air to be distilled is compressed to at least one high air pressure substantially greater than the medium pressure;
- the compressed air is cooled to an intermediate temperature, and a portion thereof is expanded in a turbine before being introduced into the medium pressure column;
- the unexpanded air is liquified, then introduced after expansion into the double column; and
- at least one liquid product is withdrawn from the double column at the production pressure, and this liquid product is vaporized by heat exchange with the air, the liquefaction temperature of the air being lower than the vaporization temperature of the liquid product.

The pressures in question in the present text are absolute pressures. Moreover, the expression "liquefaction" must be understood in the broad sense, which is to say including pseudo-liquefaction in the case of supercritical pressures.

A process of the above type is described in FR-A-2 674 011. In this process, the gaseous production under pressure is inevitably accompanied by a production of liquid, which is not desirable in all industrial applications.

The invention has for its object to permit a reduction in the production of liquid for a given production capacity of gaseous oxygen and/or gaseous nitrogen under pressure, without increasing the specific energy of each production.

To this end, the invention has for its object a process of the recited type, characterized in that only a portion of the air is expanded to an intermediate pressure, the work expanded air is partially reheated, then it is expanded in a second turbine to the medium pressure and is introduced into the medium pressure column.

In embodiments of this process:

- said intermediate temperature is lower, particularly by about 10° C., than the vaporization temperature of said liquid product;
- the inlet temperature of the second turbine is about at the liquefaction elbow of the air.

The invention also has for its object an installation adapted to practice such a process. This installation, of the type comprising a double distillation column comprising a low pressure column operating under a so-called low pressure, and a medium pressure column operating under a so-called medium pressure; compression means to bring all the air to be distilled to at least one high pressure substantially higher than the medium pressure, these means comprising a principal air compressor; means for withdrawing from the double column and pumping at least one liquid product resulting from the distillation; a heat exchange line placing in heat exchange relation the air and the liquid product; and an expansion turbine for a portion of this air, the inlet of this turbine being connected to an intermediate point in the heat exchange line, is characterized in that the heat exchange line comprises partial reheating passages whose inlet is connected to the outlet of said turbine, and in that the installation comprises a second expansion turbine whose inlet is connected to the outlet of these reheating passages and whose outlet is connected to the medium pressure column.

According to other characteristics of this invention:

- the two turbines are keyed to the same shaft;
- the shaft of the two turbines is fixed to the wheel of a blower for supercharging the air from the principal air compressor.

An embodiment of the invention will now be described with respect to the accompanying drawing, whose single figure shows schematically an installation for the production of gaseous oxygen under pressure according to the invention.

The installation shown in the drawing is adapted to produce gaseous oxygen under a high pressure of about 10 to 100 bars, liquid oxygen and liquid nitrogen.

This installation comprises essentially: a principal air compressor 1; a pre-cooler 2; an apparatus 3 for purification by adsorption; a blower-turbine assembly comprising one blower 4 and two turbines 5, 6 whose rotors are keyed to the same shaft; an atmospheric or water cooler 7 for the blower; a heat exchange line 8; a double distillation column 9 comprising a medium pressure column 10 and a low pressure column 11 coupled by a vaporizer-condenser 12 which places in heat exchange relation the nitrogen at the head of the column 10 and liquid oxygen at the base of the column 11; a liquid oxygen pump 13; a liquid oxygen storage 14 at atmospheric pressure; a liquid nitrogen storage 15 at atmospheric pressure; a phase separator 16; and a sub-cooler 17.

In operation, the column 11 is under pressure slightly greater than atmospheric pressure and the column 10 under the corresponding pressure of about 5 to 6 bars.

All the air to be distilled is compressed in 1, pre-cooled in 2° to +5° to +20° C., purified in 3 from water and CO2 and further compressed in 4 to the high pressure. After pre-cooling in 7 and then partial cooling in the passages 18 of the heat exchange line to an intermediate temperature T1, a portion of the air under the high pressure continues its cooling in the passages 19 of the heat exchange line, is liquified and then divided into two fractions. Each fraction is expanded in a respective expansion valve 20, 21, then introduced into the column 10, 11 respectively.

At temperature T1, the rest of the air under the high pressure is withdrawn from the heat exchange line, work expanded in 5 to an intermediate pressure, reintroduced into the heat exchange line, partially reheated in the passages 22 of this latter, to an intermediate temperature T2 which can be equal or not to T1, withdrawn again from the heat exchange line, work expanded in 6 to the medium pressure and introduced into the base of the column 10.

T2 can particularly be selected to be less by about 10° C than the vaporization temperature of the oxygen, and T2 to be adjacent to the liquefaction elbow of the air under the high pressure, this elbow being below the vaporization temperature of oxygen and also below T1.

In known manner, "rich liquid" (air enriched in oxygen) withdrawn from the base of the column 10 and "poor liquid" (somewhat pure nitrogen) withdrawn from the upper region of this column are, after sub-cooling in 17 and expansion in respective expansion valves 22 and 23, introduced at an intermediate level and at the head, respectively, of the column 11.

Liquid oxygen is withdrawn from the base of column 11. A fraction goes directly to storage 15, via a conduit 24, while the rest is brought by the pump 13 to the desired high production pressure, then vaporized and reheated to ambient temperature in passages 25 of the heat exchange line before being withdrawn via a conduit 26.

Moreover, liquid nitrogen under the medium pressure, withdrawn from the head of column 10, is sub-cooled in 17, expanded to atmospheric pressure in an expansion valve 27, and introduced into the phase separator 16. The liquid phase is sent to storage 15, while the vapor phase is reunited with the impure nitrogen at the head of column 11, then the mixture is reheated in 17 and then in the passages 28 of the heat exchange line and withdrawn from the installation as residual gas WN2 via a conduit 29.

Calculations performed on the basis of a production of 248 tons per day of oxygen of 99.5% purity, under 40 bars pressure, have shown that the high pressure of the air can be reduced to 25.5 bars, as contrasted to 30 bars for the arrangement of a single turbine in FR-A-2 674 011 recited above. Under the same conditions, the ratio of liquid to the capacity for separation of oxygen passes from 30% to 22%, and the specific energy of each production remains unchanged.

The invention is also applicable to the production of gaseous nitrogen under high pressure, brought by a pump (not shown) to the desired high pressure and then vaporized in the heat exchange line, and/or the production of oxygen and/or nitrogen under several pressures, by using several high air pressures.

We claim:

1. In a process for the production of at least one of gaseous oxygen and gaseous nitrogen under pressure, wherein air is distilled in a double distillation column comprising a low pressure column operating under a low pressure, and a medium pressure column operating under a medium pressure; all the air to be distilled is compressed to at least one high air pressure substantially greater than the medium pressure; the compressed air is cooled to an intermediate temperature, and a portion thereof is expanded in a turbine before introducing it into the medium pressure column; the unexpanded air is liquified, then introduced after expansion into the double column; and at least one liquid product withdrawn from the double column is brought to the production pressure, and this liquid product is vaporized by heat exchange with the air, the temperature of liquefaction of the air being less than the temperature of vaporization of the liquid product; the improvement wherein said portion of the air is expanded only to an intermediate pressure, the work expanded air is partially reheated, then it is expanded in a second turbine to the medium pressure and is introduced into the medium pressure column.

2. A process according to claim 1, wherein said intermediate temperature is less by about 10° C., than the vaporization temperature of said liquid product.

3. A process according to claim 1, wherein the inlet temperature of the second turbine is near the liquefaction elbow of the air.

4. In an installation for the production of at least one of gaseous oxygen and gaseous nitrogen under pressure, of the type comprising a double distillation column comprising a low pressure column operating under a low pressure, and a medium pressure column operating under a medium pressure, these means comprising a principal air compressor; compression means to bring all the air to be distilled to at least one high pressure substantially greater than the medium pressure; means for withdrawing from the double column and for pumping at least one liquid product resulting from the distillation; the heat exchange line placing in heat exchange relation the air and said liquid product; and a turbine for expansion of a portion of this air, the inlet of this turbine being connected to an intermediate point in the heat exchange line; the improvement wherein the heat exchange line comprises partial reheating passages whose inlet is connected to the outlet of said turbine, and in that the installation further comprises a second expansion turbine whose inlet is connected to the outlet of said reheating passages and whose outlet is connected to the medium pressure column.

5. An installation according to claim 4, wherein the two turbines are keyed to the same shaft.

6. An installation according to claim 5, wherein the shaft of the two turbines is fixed to the rotor of a blower for supercharging the air from the principal air compressor.

* * * * *